US009643191B2

(12) United States Patent
Mersmann

(10) Patent No.: US 9,643,191 B2
(45) Date of Patent: May 9, 2017

(54) METHOD AND VERTICAL MILL FOR GRINDING MATERIAL TO BE GROUND

(71) Applicant: Loesche GmbH, Duesseldorf (DE)

(72) Inventor: Matthias Mersmann, Duesseldorf (DE)

(73) Assignee: LOESCHE GMBH, Duesseldorf (DE)

( * ) Notice: Subject to any disclaimer, the term of this patent is extended or adjusted under 35 U.S.C. 154(b) by 128 days.

(21) Appl. No.: 14/427,270

(22) PCT Filed: Mar. 26, 2013

(86) PCT No.: PCT/EP2013/056418

§ 371 (c)(1),
(2) Date: Mar. 10, 2015

(87) PCT Pub. No.: WO2014/075815

PCT Pub. Date: May 22, 2014

(65) Prior Publication Data

US 2015/0246357 A1 Sep. 3, 2015

(51) Int. Cl.

| | |
|---|---|
| ***B02C 23/12*** | (2006.01) |
| ***B02C 15/04*** | (2006.01) |
| ***B02C 15/00*** | (2006.01) |

(52) U.S. Cl.

CPC ..... *B02C 23/12* (2013.01); *B02C 15/001* (2013.01); *B02C 15/04* (2013.01)

(58) Field of Classification Search

CPC ..... B02C 23/12; B02C 15/001; B02C 15/04
USPC ..... 241/119
See application file for complete search history.

(56) References Cited

U.S. PATENT DOCUMENTS

| | | | | |
|---|---|---|---|---|
| 4,597,537 | A | 7/1986 | Misaka et al. | |
| 5,622,321 | A * | 4/1997 | Brundiek | B02C 23/16 209/139.2 |
| 5,971,302 | A * | 10/1999 | Doumet | B02C 15/00 241/119 |
| 8,100,351 | B2 | 1/2012 | Lohle et al. | |

(Continued)

FOREIGN PATENT DOCUMENTS

| | | |
|---|---|---|
| GB | 2008973 A | 6/1979 |
| WO | 2005/002811 A1 | 3/2005 |
| WO | 2007022837 | 3/2007 |

OTHER PUBLICATIONS

International Search Report mailed Jan. 29, 2014 related to PCT/EP2013/056418 filed Mar. 26, 2013.

(Continued)

*Primary Examiner* — Mark Rosenbaum
(74) *Attorney, Agent, or Firm* — Dinsmore & Shohl LLP

(57) ABSTRACT

A vertical mill for grinding material to be ground and a method for this are claimed, wherein the vertical mill has a grinding table and one or more grinding rollers. A ring duct with blade ring for a transport gas flow ascending around the grinding table is provided. An annular gap distance is present between a downwardly projecting oversize material cone and the upper region of the grinding rollers, through which annular gap distance a proportion of fine particles is also fed back in a recirculating manner to the grinding table. In order to overcome this disadvantage, a barrier gas flow flowing from inside to outwards is provided in the region of the gap distance, whereby the recirculation of grinding particles of a certain size can be prevented.

12 Claims, 3 Drawing Sheets

(56) References Cited

U.S. PATENT DOCUMENTS

2015/0034746 A1* 2/2015 Storm ..... B02C 15/001
241/47

OTHER PUBLICATIONS

International Preliminary Report on Patentability, issued in related application PCT/EP2013/056418 dated Sep. 29, 2015.

* cited by examiner

METHOD AND VERTICAL MILL FOR GRINDING MATERIAL TO BE GROUND

The invention relates to a method for grinding material to be ground in a vertical mill according to the preamble to claim 8 and to a vertical mill according to the preamble to claim 1.

Figure 3:
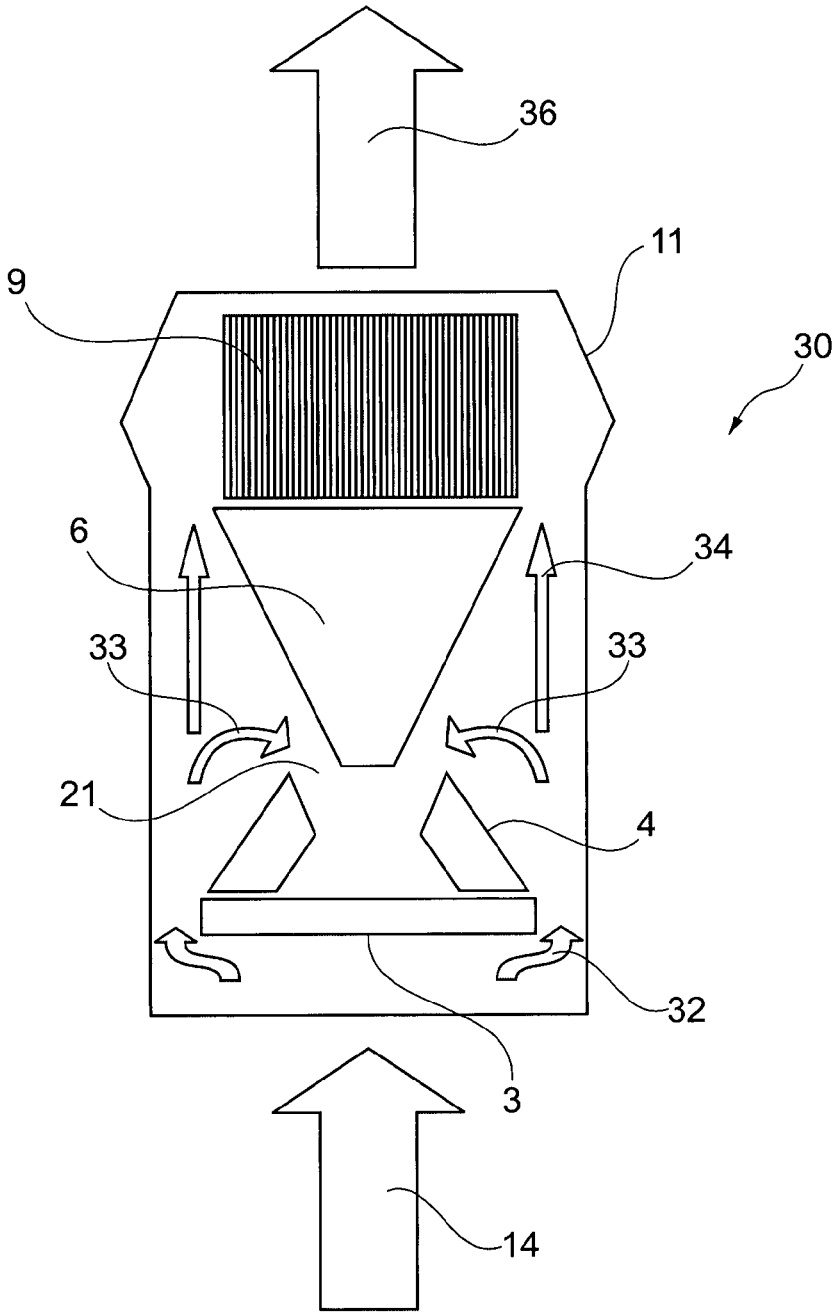

A vertical mill according to the preamble to claim 1 is known for example from EP 1 675 683 B1 and is shown schematically with the essential components in FIG. 3.

Such a vertical mill has a rotating grinding table 3, on which grinding rollers 4 or grinding rolls are provided to comminute and grind the material to be ground which is fed for example as cement clinker or raw coal into the central region of the grinding pan 3.

In dependence upon the type of material to be ground fed to the grinding pan 3, there is a main gas flow 14, which is usually a hot gas flow in a grinding-drying process, through the vertical mill 30 from the bottom upwards. The hot gas blown in from the bottom, which serves as transport and drying gas, is fed, in a ring duct arranged circularly around the grinding pan 3 with a blade ring, through the limitation of the mill housing 11 upwards extensively into a vertical transport flow for ground particles.

The particles fed upwards are classified in the upper region by means of a classifier 9 which is usefully designed as a dynamic, rotating classifier. Larger particles of the material to be ground which are rejected by the classifier are fed back by the oversize material cone 6, arranged below, onto the grinding table 3 for further grinding.

Due to the form of the oversize material cone 6 and the arrangement of grinding rollers 4 or grinding rolls, a free annular gap 21 is formed in the lower region of the oversize material cone between the latter and the upper region of the grinding rollers 4.

On the other hand, in this design of the vertical mill, there is a widening of the space volume in the space between the grinding rollers 4 and the housing 11 of the vertical mill 30. The form of the oversize material cone also contributes to this such that a pressure drop arises in this widened space for the flow 32 leaving through the ring duct with blade ring. As a result of the pressure drop, the fine particles ascending through the flow 32 pass in a recirculation flow 33 into the annular gap 21 and are fed back again to the grinding table and grinding process through the rollers.

This effect of the recirculation and reflowing around the grinding rollers, in particular by fine particles, is increased with increasing mill size and in particular with increasing diameter of the grinding pan 3.

This flow pattern leads, however, to a considerable impairment in the operating output of a vertical mill, as primarily the small fine particles, due to their lower mass, follow the pressure drop or respectively the gas suction into the annular gap 21. The small particles of the material to be ground which are drawn in this way into the annular gap 21 do not only constitute an unnecessary burden on the grinding material circuit of the vertical mill and thus increase the pressure loss produced, but instead they also impair the incorporation and load properties of the grinding bed on the grinding table, which results in an increased tendency for vibration.

As this problem and the associated disadvantages are continuously growing with increasing size of the vertical mills—as is shown in the form of high pressure losses within the vertical mill, high operating vibrations of the grinding rollers and thus an impairment of the operating efficiency of a vertical mill—these issues must be overcome.

It is an object of the invention to design a generic vertical mill such that an improvement in the operating efficiency, in particular by avoiding recirculation of fine particles, is achieved, whereby this can also be implemented in a corresponding method.

This object is solved according to the invention in a generic vertical mill by means of the features of the characterising part of claim 1 and with a method by means of the features of claim 8.

It can be seen as a core idea of the invention to provide a feed unit for a barrier gas flow in the lower region of the oversize material cone, the flow direction of said barrier gas flow leading from inside to outside and keeping fine particles away from the annular gap distance between the outlet of the oversize material cone and the upper region of the grinding rollers and thus avoiding a recirculation of these fine particles.

A supplementary core idea of the invention lies in branching off a part of the transport and drying gas flow required in total for a grinding-drying operation in the vertical mill, before entry into the ring duct with blade ring, said branching-off being below the grinding pan, and instead introducing this partial gas flow above the grinding rollers at the height of the outlet from the oversize material cone as a partial gas or barrier gas flow from inside to outwards of the vertical mill.

This barrier gas flow is usefully realised distributed evenly in the region of the annular gap distance thus covering an area of 360°. In structural terms this can be achieved by means of a ring duct or an annular line on the outer side of the lower region of the oversize material cone.

The barrier gas flow can usefully also be blown in distributed in sectors in volume terms, thus covering an area of 360°, in such a way that a stronger barrier gas flow is provided in regions of an increased occurrence of fine particles.

Advantageous further developments of the vertical mill according to the invention are indicated in the sub-claims 2 to 7 and, having regard to the method, in claims 9 to 12 with the incorporation of the description.

The feed unit for the barrier gas flow is favourably designed in terms of flow on the lower region of the oversize material cone as a gas duct surrounding said oversize material cone in such a way that the barrier gas flow with outward flow direction produces a channelling-off of fine particles fed to the annular gap distance and deflects these fine particles into the ascending transport and drying gas flow.

A pneumatic barrier is thus realised on the annular gap distance between the oversize material cone and grinding rollers.

The operating efficiency of the vertical mill is hereby improved in terms of the relationship between properly output fine particles and total energy of the vertical mill required for this.

In a further alternative, the gas duct is realised in the lower region of the oversize material cone with a plurality of surrounding ring duct segments.

This facilitates an inflow of the barrier gas at approximately the same pressure around the circumference of the oversize material cone. On the other hand, in terms of flow, a better ascent of the transport and drying gas on the outer cone surface of the oversize material cone into the distances, remaining free, between the individual ring duct segments is facilitated.

A further improvement is also achieved by a bypass line for the barrier gas flow being branched off from the main supply line of the vertical mill for the transport and drying gas. The gas volume fed through the ring duct with blade ring is hereby reduced. This subsequently leads in the widened flow space between the outer region of the grinding rollers and the housing of the vertical mill to a lower pressure and accordingly to a lower pressure loss.

Insofar as no hot gas is required as drying gas in the vertical mill, the barrier gas flow can also be introduced as a separate gas flow, in particular as ambient air or fresh air, into the corresponding feed unit.

It is also hereby possible to reduce the transport gas volume ascending through the ring duct around the grinding table.

A separate supply of cooling gas on a point-by-point basis via nozzles or via a ring duct provided on the inner side of the housing of a vertical mill above the grinding rollers is indeed known. The flow direction of the cooling gas is hereby directed from outside to inwards and serves solely for cooling and reducing the temperature of ground particles, for example of ascending fine particles in the grinding of cement clinker.

According to the invention the barrier gas flow directed from inside to outwards is advantageously provided with a vertical flow component. In this way a favourable transition, in terms of flow, together with the vertically ascending transport gas flow is produced.

In a further alternative of grinding roller position and outer contour of the oversize material cone, the oversize material cone can also have a cylindrical form in particular in the lower region, said cylindrical form extending into the free space of opposing, extensively vertically orientated grinding rollers. In this configuration the space volume, which surrounds the oversize material cone and grinding rollers outwardly towards the inner wall of the housing of the vertical mill, is extensively evened out. As a result, pressure losses in this region as well as a recirculation of fine particles into the annular gap distance can be reduced.

In terms of the method, the object of the invention is achieved with the features of claim 8. A barrier gas flow with flow direction from inside to outwards into the and/or over the annular gap distance is hereby produced in the lower region of the oversize material cone, so that inflow and recirculation of fine particles into the gap distance can be prevented.

The barrier gas flow is hereby usefully branched off via a bypass line as part of the main gas flow, produced for the vertical mill, for transport and drying gas, whereby this is realised in particular below the grinding table.

When introducing the barrier gas flow with a vertical flow component, the ascending transport and/or drying gas flow is hereby increased in terms of volume, whereby the pneumatic conveyance of the ground particles is improved.

A further advantage is achieved when the volume and/or the temperature of the barrier gas flow can be regulated and this is realised in particular as a function of the fine particles desired.

Seen as a whole, several improved effects are achieved through the invention.

Fine particles are no longer fed, within the scope of a recirculation, back to the grinding table and hence to the grinding bed, but instead reach the classifier. The composition of the grinding bed is hereby positively influenced and the vibration tendency is reduced.

The proportions of the finished material or fine particles in the material circuit within the vertical mill are reduced, which leads to an overall unburdening of the pneumatic transport in the vertical mill and thus increases the throughput and reduces the pressure loss.

The gas speed in the ring duct with blade ring decreases by the proportion of the barrier gas flow branched off in the bypass, whereby the pressure loss is considerably reduced.

The reduced gas speed in the blade ring facilitates the operation of the vertical mill with a controlled production of rejects. This in turn reduces the pressure loss in the vertical mill, as oversize grinding particles then no longer have to be pneumatically recirculated, but instead can be recirculated in an external mechanical circuit, for example by bucket conveyor.

All in all, therefore, an improvement in the operating output and operating efficiency is achieved.

The invention can thus be used in all construction types of vertical mills, wherein a cross-sectional widening for the transport and drying gas flow is present above the rollers, since the problem of recirculation of fine particles is present in particular in this region.

Figure 1:
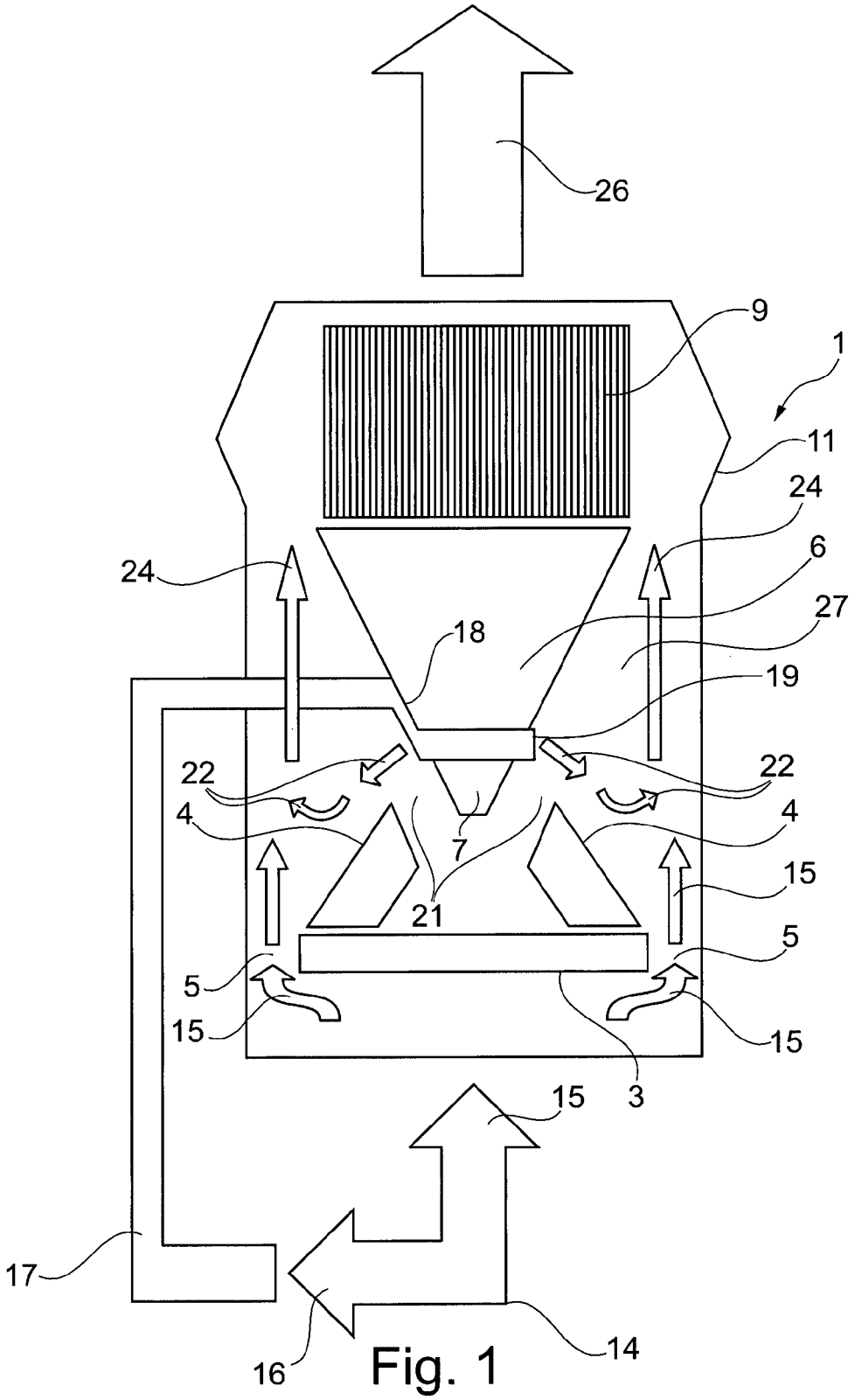
Figure 2:
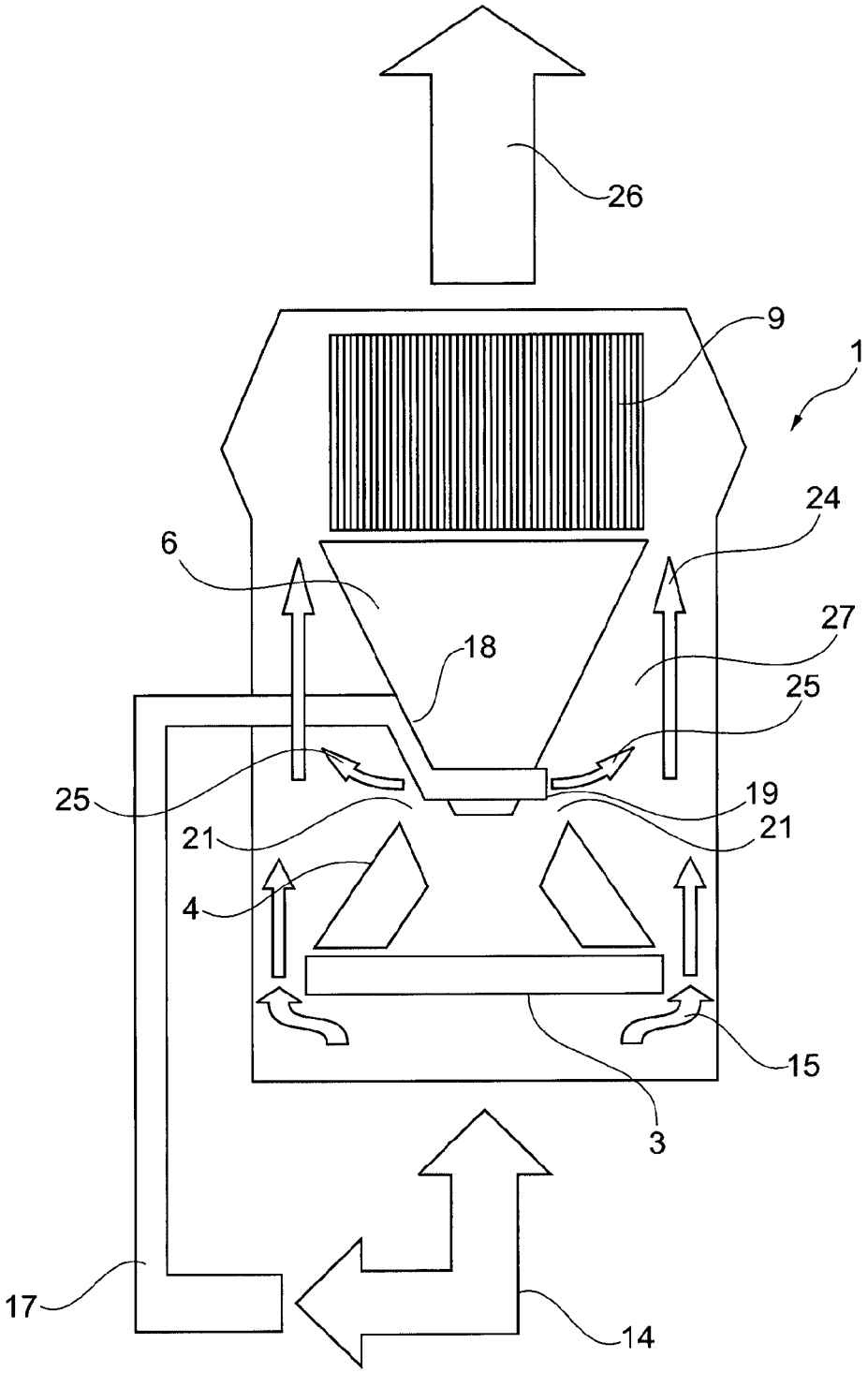

The invention will be explained in more detail below by reference to schematic examples. In the drawing:

FIG. 1 shows, in a highly schematic representation, a vertical section through a vertical mill according to the invention with a bypass line and a barrier gas flow outwards;

FIG. 2 shows the vertical mill according to FIG. 1 with a barrier gas flow with a vertical component; and FIG. 3 shows a vertical mill according to the prior art in the schematic vertical section with the essential components corresponding to FIG. 1 but with the recirculation flow—which is problematic and is to be avoided—for fine particles in an annular gap between the grinding rollers and oversize material cone.

FIGS. 1 to 3 show coinciding components of the vertical mills 1 and 30 with the same reference symbols. This also applies to the gas flows, insofar as these coincide.

The vertical mills shown in FIGS. 1, 2 and 3 have the same structure having regard to the essential components such as grinding table 3, grinding rollers 4, oversize material cone 6 and classifier 9, arranged above, with surrounding mill housing 11.

The problematic recirculation flow 33 (FIG. 3) of upwardly guided fine particles and the deflection thereof inwards into the annular gap 21, also due to the pressure drop in the flow region between the mill housing 11 and the outer contour of the oversize material cone 6, are overcome in a way that is simple in terms of construction and method through the solutions according to FIGS. 1 and 2.

In the example of the vertical mill 1 according to FIG. 1, a partial flow is branched off from the main gas flow 14 via the bypass line 17.

Insofar as the grinding process carried out in the vertical mill is a grinding—drying process, for example for moist raw coal, hot gas is produced in a hot gas generator and is fed as a main gas flow 14 to the vertical mill 1 below the grinding table 3. The branching-off of the partial gas flow via the bypass line 17 hereby takes place below the grinding table 3 or outside of the mill housing 11. This is represented schematically through the arrows 15 as a flow through the ring duct 5 with blade ring.

This flow 15 transports the grinding particles, ground between the grinding rollers 4 and grinding table 3 and fed outwardly into the region of the ring duct 5, extensively vertically upwards. This pneumatic transport function is dependent in particular upon the flow speed and the flow volume of the transport and drying gas.

Also in the example according to FIGS. 1 and 2, there is an annular gap 21 between the lower region of the oversize material cone 6 and the upper region of the grinding rollers 4, through which annular gap 21 already over-ground material can fall back onto the grinding table 3 or is recirculated.

Having regard to ascending fine particles in the flow 15, however, this is prevented by a barrier gas flow 22 being produced, in the lower region of the oversize material cone 6, from inside to outwards to shield the annular gap 21 against an entry of fine particles in this region.

This barrier gas flow 22 has been branched off from the main gas flow 14 as a bypass flow 16 and introduced via the bypass line 17 and the feed unit 18 into a ring duct 19 surrounding the oversize material cone 6 and blown there around the whole periphery of the ring duct 19 as a barrier gas flow 22 with flow direction from inside to outwards into the free space for the transport flow 24.

The bypass line 17 is hereby guided above the grinding rollers 4 approximately horizontally through the mill housing 11 on a short path to the outer surface of the oversize material cone 6 and, in the example shown, over a short stretch on the oversize material cone 6 downwards to the ring duct 19.

The bypass flow 16 can flow through the ring duct 19 in a direction around said ring duct 19.

In order to create approximately identical pressure conditions all around for the outflowing barrier gas flow 22, the ring duct 19 can also have for example two 180° segments, through which flows take place in opposite directions.

It is also possible to provide a plurality of bypass lines with the same angle distance relative to each other. For example, three bypass lines 17, respectively offset by 120°, can be connected in terms of flow to a respective one of three ring duct segments 19.

The barrier gas flow 22 in FIG. 1 blocks the annular gap 21 in the upper, inner region against a penetration of fine particles. The barrier gas flow is deflected further outwards upwardly into the vertical transport flow 24 so that an upward flow with a larger volume is available for ground particles.

The barrier gas flow 22 can be controlled in dependence upon output volume, output speed and output angle from the ring duct 19 in such a way that a recirculation of fine particles is prevented from a certain fineness and is fed with the vertical transport flow 24 upwards to the classifier 9.

The barrier gas flow 22 should thus be set so that over-ground but coarser grinding material particles are recirculated through the annular gap 21 back to the grinding table 3. The branching-off of the bypass flow as a barrier gas flow to prevent recirculation of certain particle sizes through the annular gap 21 ultimately leads to an improvement in the energy balance of the vertical mill in comparison with the desired fine particles output.

The example according to FIG. 2 corresponds, apart form the barrier gas flow 25, to the exemplary embodiment according to FIG. 1.

In FIG. 2, the barrier gas flow 25 leaving through the ring duct 19 has above the annular gap 21, besides an outwardly directed flow component, also a vertical flow component.

This allows on the one hand the blocking of an entry of fine particles of a certain fineness into the annular gap 21 and on the other hand a joint flow, favourable in terms of flow, with the ascending transport flow 24 such that a homogenisation but also a reinforcement of the volume of the transport flow 24 are achieved. The fluid flow 26 leaving the classifier upwardly is a fine particles/gas mixture, from which the fine particles are separated in upstream cyclones and/or filters.

The device according to the invention and the method according to the invention thus create a relatively simple possibility of being able to achieve a more efficient operation of such a vertical mill by blocking the recirculation of certain particle sizes.

The invention claimed is:

1. A vertical mill for grinding material to be ground, comprising a grinding table and a plurality of grinding rolls or grinding rollers arranged so as to rotate thereon, a ring duct surrounding the grinding table to introduce an ascending transport and/or drying gas flow, an oversize material cone, arranged centrally relative to the grinding table, approximately above the grinding rolls or grinding rollers and tapering downwards, for the recirculation of coarse oversize particles onto the grinding table, and an approximately annular gap distance between the lower outlet region of the oversize material cone and the upper region of the grinding rolls or grinding rollers, wherein a feed unit for a gas flow with outward flow direction is provided in the lower region of the oversize material cone to deflect fine particles fed to the annular gap distance into the ascending transport and/or drying gas flow.

2. The vertical mill according to claim 1, wherein the feed unit is designed as a gas duct surrounding the lower region of the oversize material cone.

3. The vertical mill according to claim 2, wherein the gas duct surrounds the lower region of the oversize material cone as a ring duct or with a plurality of ring duct segments around it.

4. The vertical mill according to claim 1, wherein the gas duct of the feed unit is provided for the gas flow, acting as a barrier gas flow, as a bypass line to the main supply line of the vertical mill for transport and/or drying gas.

5. The vertical mill according to claim 1, wherein a barrier gas flow is fed separately to the transport and/or drying gas flow as ambient air or fresh air.

6. The vertical mill according to claim 1, wherein a barrier gas flow has a vertical flow component directed from inside to outside.

7. The vertical mill according to claim 1, wherein the space volume in the vertical mill is evened out for the transport and/or drying gas flow ascending in the region of the grinding rolls respectively grinding rollers and the oversize material cone.

8. A method for grinding material to be ground in a vertical mill, having a grinding table and at least one grinding roll or grinding roller arranged so that it can rotate thereon, wherein an ascending transport and/or drying gas flow is introduced via a ring duct surrounding the grinding table, wherein coarse oversize materials are fed back to the grinding table via an oversize material cone arranged centrally relative to the grinding table, approximately above the grinding roll or grinding roller, and tapering downwards, wherein an approximately annular gap distance is formed between the lower outlet region of the oversize material cone and the upper region of the grinding roll or grinding roller, wherein a barrier gas flow is fed in the lower region of the oversize material cone, with flow direction from inside to outside into and/or via the annular gap distance against an inflow and recirculation of fine particles into the gap distance.

9. The method according to claim 8, wherein the barrier gas flow is branched off from the main gas flow for transport and drying gas produced for the vertical mill.

10. The method according to claim 8, wherein the barrier gas flow is fed as an external gas flow of ambient air or fresh air.

11. The method according to claim 8, wherein the barrier gas flow fed as a partial gas flow is blown in with a vertical flow component and the ascending transport and/or drying gas flow is thus reinforced in terms of volume.

12. The method according to claim 8, wherein the volume and/or temperature of the barrier gas flow is/are regulated as a function of the desired fine particles.

* * * * *